US005294107A

United States Patent [19]

Allmendinger et al.

[11] Patent Number: 5,294,107

[45] Date of Patent: Mar. 15, 1994

[54] DEVICE FOR DIRECTING SHEETS ONTO A DEPOSITING SURFACE

[75] Inventors: Franz Allmendinger, Eichwald; Manfred Baumann, Neckartailfingen; Siegfried Garbe, Stuttgart; Heinz Michels, Wolfschlugen, all of Fed. Rep. of Germany

[73] Assignee: Eastman Kodak Company, Rochester, N.Y.

[21] Appl. No.: 24,003

[22] Filed: Feb. 26, 1993

[30] Foreign Application Priority Data

Mar. 6, 1992 [DE] Fed. Rep. of Germany ..... 4207069

[51] Int. Cl.[5] ..... B65H 31/26

[52] U.S. Cl. ..... 271/220

[58] Field of Search ..... 271/220, 225, 303, 184, 271/189

[56] References Cited

U.S. PATENT DOCUMENTS

| | | | |
|---|---|---|---|
| 4,314,644 | 2/1982 | Stocker | 271/225 X |
| 4,571,234 | 2/1986 | Labombarde | 271/225 X |
| 4,626,672 | 12/1986 | Sapitowicz et al. | 271/225 X |
| 5,033,731 | 7/1991 | Looney | 271/220 X |

FOREIGN PATENT DOCUMENTS

| | | | |
|---|---|---|---|
| 3843281A1 | 6/1990 | Fed. Rep. of Germany | B65H 29/00 |

*Primary Examiner*—David H. Bollinger
*Attorney, Agent, or Firm*—Lawrence P. Kessler

[57] ABSTRACT

A device for directing individually supplied sheets onto a sheet depositing surface includes a feeder for feeding sheets along a sheet path onto the surface and a pivotably mounted sheet directing element that includes a first arm which extends across the sheet path. The pivotable directing element includes a weight mounted thereto above its pivot axis for increasing the moment of inertia of the pivotable directing element.

7 Claims, 3 Drawing Sheets

DEVICE FOR DIRECTING SHEETS ONTO A DEPOSITING SURFACE

BACKGROUND OF THE INVENTION

1. Technical Field

The invention relates to a device for directing individually supplied sheets onto a depositing surface. The directing device includes a sheet feeding means for moving a sheet along a path of movement, which extends transversely to the vertical, onto a depositing surface which is downwardly inclined in opposition to the sheet feeding direction. It also includes a directing element associated with the exit area of the sheet feeding means, that is deflected by the leading edge of a sheet from the path of movement thereof and that forces the trailing end of the sheet downwards when such end has been disengaged by the sheet feeding means.

2. Background Art

In known devices of this type, a first arm of a two-armed pivotally mounted hold-down element senses the sheets transported before they leave the sheet feeding means. The first arm rests on the sheet. A second arm of the hold-down element is arranged above the path of movement of the sheets and behind the area where the sheets leave the sheet feeding means. As soon as a sheet has passed the first arm of the hold-down element, the hold-down element is pivoted under the action of gravity such that its second arm depresses the trailing end of a sheet. As such, a successive sheet can be placed on a stack of deposited sheets without its movement being obstructed.

SUMMARY OF THE INVENTION

It is the object of the invention to provide a device of the generic type such that the trailing end of a sheet can be influenced without the preceding sheet first having to be sensed.

According to the invention this object is attained in that

- the directing element has at least one arm which is mounted for swinging movement above the path of movement of the sheets and extends into the path of movement of the sheets exiting the sheet feeding means,
- a weight is mounted to the directing element above the element's mounting pin to increase the moment of inertia thereof, and
- the directing element is biased by a resetting spring.

According to an advantageous modification of the invention the directing element is designed as a two-armed lever whose first arm is arranged below the mounting pin and extends into the path of movement of the sheets exiting the sheet feeding means and whose second arm which is arranged above said mounting pin is provided with the weight which increases the moment of inertia.

Advantageously a first greater weight portion is arranged on the side of the mounting pin facing the sheet feeding means and a second smaller weight portion is positioned on the side of the mounting pin facing away from said means.

The directing element is provided with a plurality of arms extending into the path of movement of the sheets and arranged transversely thereto. Each arm of the plurality of arms passes through a slot of a guide element which is arranged in the exit area of the sheet feeding means, and thus acts to guide the incoming sheets at an acute angle towards the depositing surface.

According to an advantageous modification of the invention, the depositing surface is formed by two directly superimposed surface elements of different lengths, which are pivotable about a common journal at their upstream ends and of which the upper surface element is shorter at its free downstream end than the lower surface element.

Thanks to the arrangement and design of the directing element according to the invention the moment of inertia of the weight arranged on it in a particular manner causes the directing element to carry out a delayed return movement. As such, each sheet can first be deposited without its movement being obstructed, and then directed promptly and reliably to its intended position as a result of the increasing mass acceleration of the directing element.

BRIEF DESCRIPTION OF THE DRAWINGS

Further features and advantages can be inferred from an embodiment of the invention illustrated in the drawing and from the subclaims.

In the schematical drawing.

Figure 1:
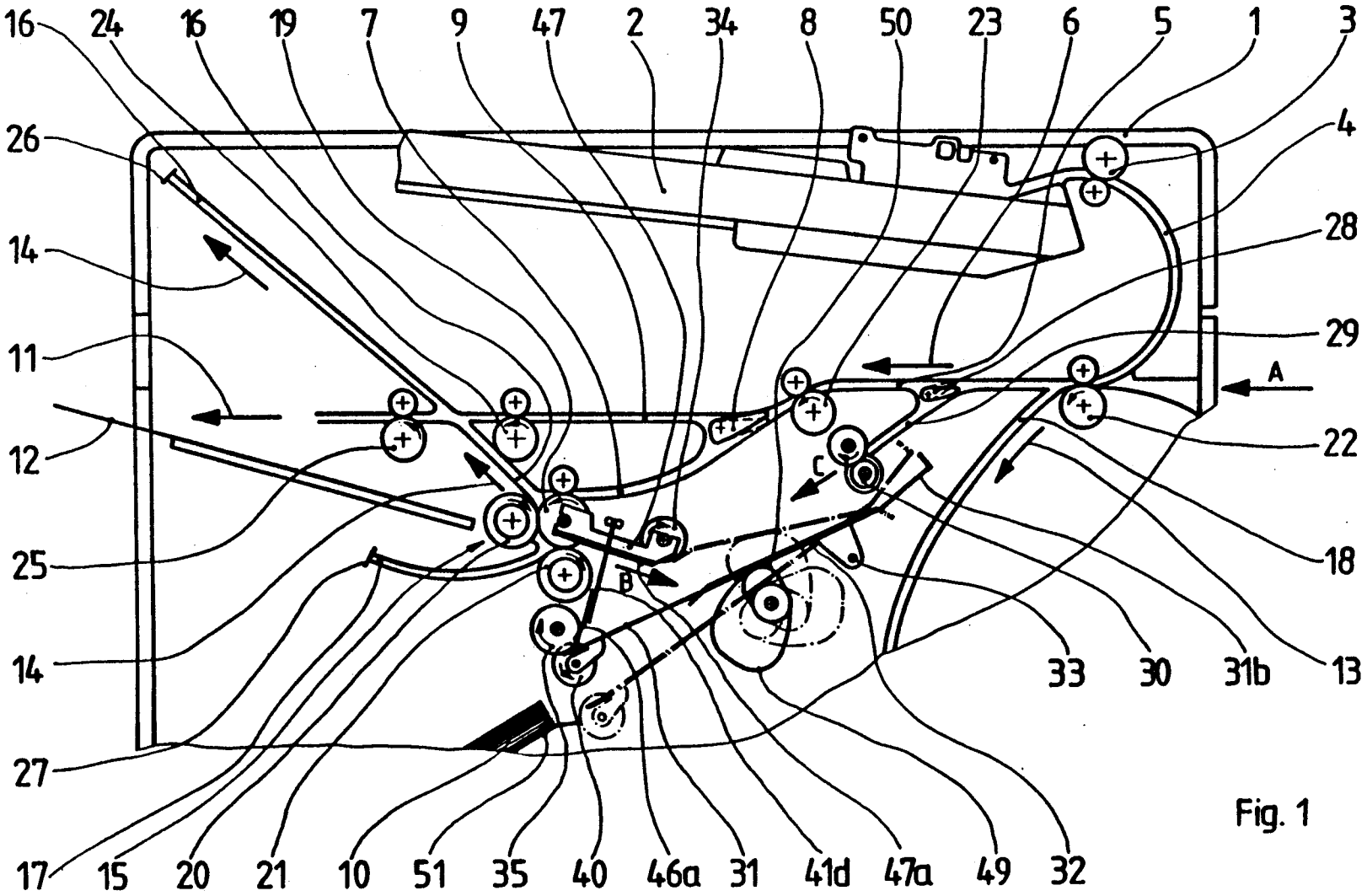
FIG. 1 shows a lateral view of the device.

The sheet directing device according to the invention is part of a unit for further processing of individually supplied copy sheets arriving from a copier.

DETAILED DESCRIPTION OF THE PREFERRED EMBODIMENT

Of the processing unit 1 referred to as a finisher, which allows a plurality of finishing operations to be performed such as collecting sheets in sets, stacking, stapling, Z-folding, spine stapling and subsequent folding, inserting of cover and slip sheets as well as previewing of the copy sheets supplied, only those components are illustrated in the drawing as are necessary to understand the invention.

In finisher 1, which is directly connected to a copier (not illustrated), copy sheets arriving from the direction of the arrow "A" or sheets or transparencies taken from an input tray 2, are handled in a manner to be described below. The individual processing operations are preselected on the copier.

With respect to the subject matter of the application, the sheets according to FIG. 1 are transported substantially by means of pairs of transport rollers 22, 23, 24, 25 along guide channels 5 and 9 in the direction of the arrows 6 and 11 until they reach a previewing station 12 or they are advanced by means of pairs of transport rollers 22, 23 along guide channels 5 and 7 in the direction of the arrows 6 and 14 until they reach a buckle-folding device 15 of a type known per se.

FIG. 1 shows a pivotable deflector 8 which is associated with the guide channels 5, 7 and 9 and which, when in its position shown in dash-dotted lines, directs a sheet entering guide channel 5 in the direction of the arrow 6 into guide channel 9. In guide channel 9, the sheet is transported by the pairs of transport rollers 24 and 25 in the direction of the arrow 11 to the previewing station 12 where the quality of the copy is checked. After a correction, possibly required, has been made on the copier, the actual finishing operation can be started.

If the copier is set to a Z-folding operation, deflector 8 is adjusted to the position shown in FIG. 1 in which a sheet arriving in the direction of the arrow 6 is deflected into guide channel 7 in which it is conveyed to the folding rollers 19 of the buckle-folding device 15. The folding rollers 19 first transport the sheet in the direction of the arrow 14 into a long and narrow guide channel 16 until it contacts an abutment 26. The folding rollers 19 continue their shifting action and thus cause the sheet to buckle so that it is bent in the area of the folding rollers 19, 20. The resultant loop is engaged by the nip of the folding rollers 19, 20 in a manner known per se. The sheet is thus given its first fold and is then shifted in opposition to the direction of the arrow 14 into an equally narrow but shorter guide channel 17 until it contacts an abutment 27. The folding rollers 19 and 20 which continue their shifting action cause another bending of the sheet. The resultant loop is received in the nip of the folding rollers 19 and 21 which produce a second fold whereupon the sheet, now having been provided with a Z-fold in the manner described, is fed out by the rollers in the direction of the arrow "B".

In addition to being Z-folded as described above, the sheets fed in the direction of the arrow "A" can also be controlled by a corresponding preselection on the copier (deflector 28 in position shown in dash-dotted lines) such that they are deflected into guide channel 29. There they are fed out through a pair of transport rollers 30 in the direction of the arrow "C" to an abutment (not illustrated) of a collecting tray 51 in which they are collected in a sheet stack 10. The sheet stack 10 as accumulated is then selectively stapled or not, and is fed to a depositing device (not illustrated).

In the area where the sheets arrive from the direction of the arrow "B" and "C" respectively, two directly superimposed surface elements 31 and 32 are arranged for pivotal movement about a common journal 33. The surface elements 31 and 32 are located in a position in which they are downwardly inclined towards collecting tray 51. The upper surface element 32 is shorter in the downstream direction than the lower surface element 31, and has a free end **32*a* that is bent downwardly at several points and is received in corresponding openings 31*a* of the lower, longer surface element 31 (see FIG. 2). The transition from the lower surface element 31 into the upper surface element 32 in the upstream direction is thus almost continuous. Moreover, a plurality of raised ribs 48 extending in the direction of movement of the sheets are arranged on the lower surface element 31. The ribs 48 which are positioned between the bent-off ends 32*a* of the upper surface element 32 extend up to the depositing plane of the upper surface element 32 in the upstream direction and together with the element 32** form an almost continuous sliding plane for the sheets.

The surface elements 31 and 32 (which in a manner to be described further below) serve as guide elements or temporary depositing surfaces, depending on the mode of operation selected. They are held in engagement with a larger and a smaller cam 49 and 50 respectively that are mounted on a shaft of a setting motor (not illustrated) which can be actuated by preselection on the copier. The larger cam 49 extends through the lower surface element 31 and rests against the lower side of the upper surface element 32. The smaller cam 50 engages the lower side of the lower surface element 31. By means of the cams 49 and 50, the surface elements 31 and 32 can be pivoted into different positions. This allows sheet formats of various dimensions to be collected in collecting tray 51 without any disturbances. With respect to the direction of transport "C", three different sheet format ranges can be set, namely "short", "medium" or "long".

In the case of an adjustment to the long sheet-format range, the surface elements 31 and 32 are pivoted by the cams 49 and 50 into their lowermost positions indicated in dash-dotted lines in which they form a continuous depositing plane with the collecting tray 51 such that the incoming sheets after having left the transport rollers 30 can slide down to the front abutment of collecting tray 51 under the action of gravity. The rear end of the sheets is thereby positioned below the nip of the transport rollers 30 so that the sheets already deposited are placed outside the transport path of the incoming sheets and cannot obstruct them.

If shorter sheets are to be deposited, provisions must be made in order that the incoming sheets cannot strike against the more downwardly positioned rear edges of the sheets already deposited. In the case of medium sheet formats, e.g. a DIN-A4 standard size sheet entering in the longitudinal direction, the upper shorter surface element 32 is pivoted for this purpose by the larger cam 49 into the upper position shown in dash-dotted lines. The surface element 32 now upstanding to form a type of ramp rests with its free end on stationary transport rollers 34 driven by a shaft 39 so that the incoming sheets can be reliably guided above the maximum stack height onto the sheets already deposited and placed on top of them.

If the sheets to be deposited belong to the short format range, i.e if they are for example DIN A5 size sheets arriving in a longitudinal orientation or DIN A4 size sheets arriving in a transverse orientation, the lower surface element 31 is pivoted upwards by the smaller cam 50 into the position illustrated in FIG. 1, taking along the superimposed surface element 32 to that position.

Figure 2:
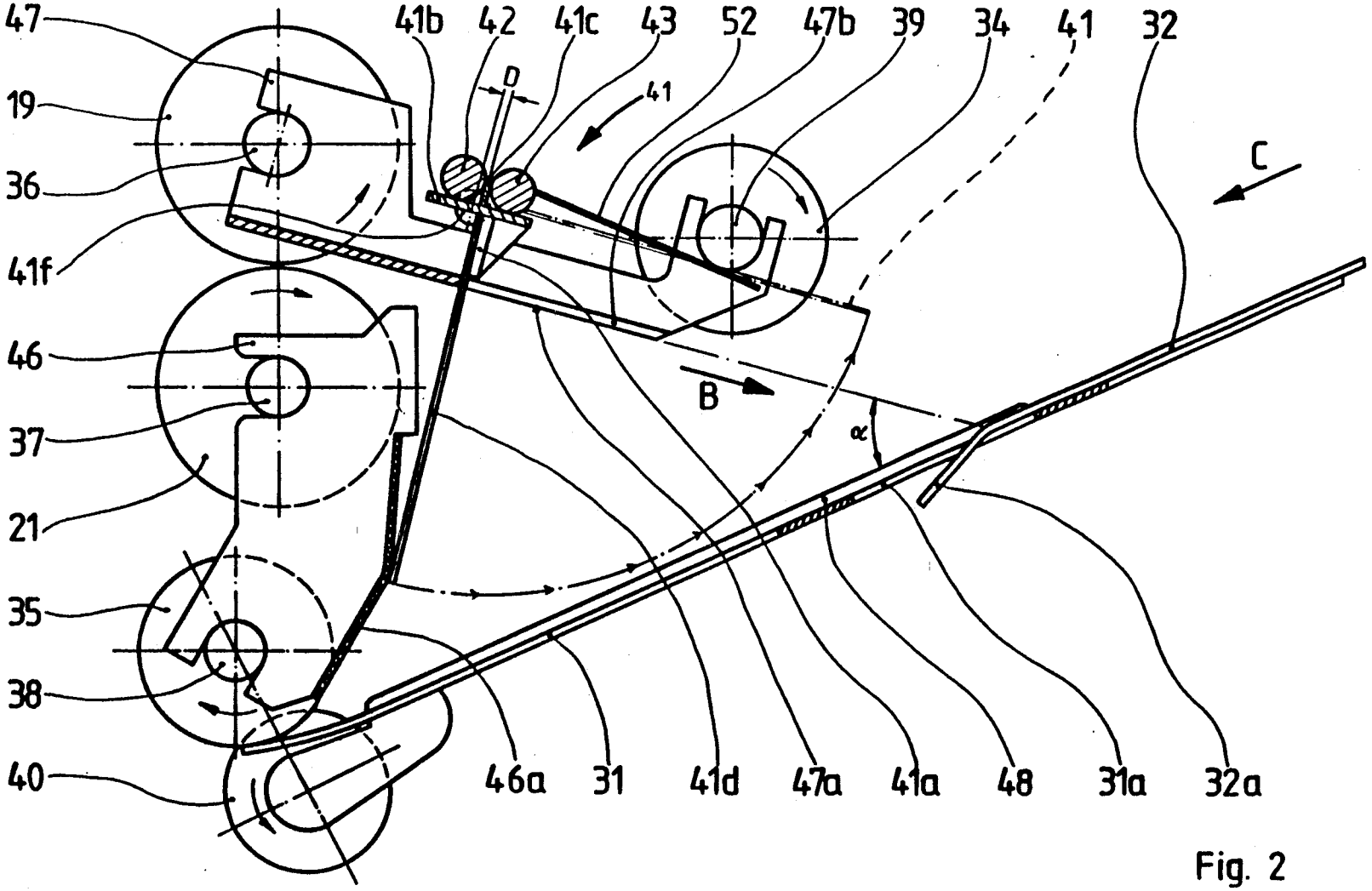
FIG. 2 shows the device according to FIG. 1 with an enlarged partial view of the area including the directing element.

A plurality of pressure rollers 40 are mounted for rotation at the free end of the lower surface element 1 and, as shown in FIGS. 1 and 2, rest against opposite transport rollers 35. The transport rollers 35 are driven by a stationarily mounted shaft 38. This arrangement of the surface elements 31 and 32 ensures that short sheet formats, too, when leaving the transport rollers 30, are further transported in the downstream direction by the transport rollers 35, 40, and are reliably directed above the maximum stack height onto sheets already deposited and stacked on top of them, without obstructing each other.

If the Z-folding mode of operation has been preselected, the surface elements 31, 32 also assume the aforedescribed position shown in FIGS. 1 and 2. When, in this mode of operation, a sheet has passed the buckle-folding device 15, it is fed out by the folding rollers 19 and 21 in the direction of the arrow "B". The folded sheet thus fed out arrives at the sliding plane of the surface elements 31 and 32 and slides on them in the upstream direction until it contacts an end abutment **31*b* which extends transversely to the sliding direction of the sheet (see FIG. 1). A number of identical preloaded leaf springs (not illustrated) which extend into the path of movement of the incoming sheet are arranged on the end abutment 31*b* against which they come to rest when the folded sheet impacts abutment 31***b*. The folded sheet is thus aligned via its upstream end edge such that it is parallel to the sliding direction "C". The bias of the leaf springs on the abutment thus released imparts to the folded sheet a momentum directed oppositely to the feed-out direction "B" and in the sliding direction "C" so that the sheet can now slide downstream onto the transport rollers 35, 40.

After having left the folding rollers 19, 21 both the leading end and the trailing end of a folded sheet must be guided such that no disturbances occur during further transport. For this purpose the folded sheet must be guided free from disturbances past the transport rollers 34, which are driven in opposition to the feed-out direction "B", onto the surface elements 31 and 32. Moreover, the rear end of the folded sheet which has been released by the folding rollers 19 and 21 must be reliably and promptly advanced into the transport plane intended for further transport.

To this end a guide element 47 having a guide surface 47*a*, is locked with the shaft 36 and 39 respectively of folding roller 19 and transport roller 34, respectively. The plane of guide surface 47*a* extends from the transport nip of the transport rollers 19 and 21 to, and below, the transport rollers 34 and is aligned at an acute angle a of less than 45° with respect to the surface elements 31 and 32. As such, a folded sheet guided along guide surface 47*a* contacts the upper surface element 32 upstream of the bent-off ends 32*a*.

Since the area on which such sheets are being guided is moreover bridged by the ribs 48 of surface element 31, the front portion of the incoming folded sheet can slide reliably in the upstream direction onto the surface elements 31 and 32 which serve as a temporary depositing surface. Although the folded sheet is transported out of the folding rollers 19, 21 such that its Z-folded end which is situated on the lower side comes first, no guiding of the folded sheet is possible directly before the sheet arrives on the surface elements 31 and 32. As such, the folded portions on the lower side may hang down, and the folded sheet can be deposited without any disturbance because it slides onto the stepless surfaces at an acute angle.

In order that the rear end of a folded sheet disengaged by the folding rollers 19 and 21 can arrive on the depositing plane of the surface elements 31 and 32 reliably and promptly, a directing element 41 is arranged in the exit area of the folding rollers 19 and 21 to depress the rear end in a functionally useful manner.

Figure 3:
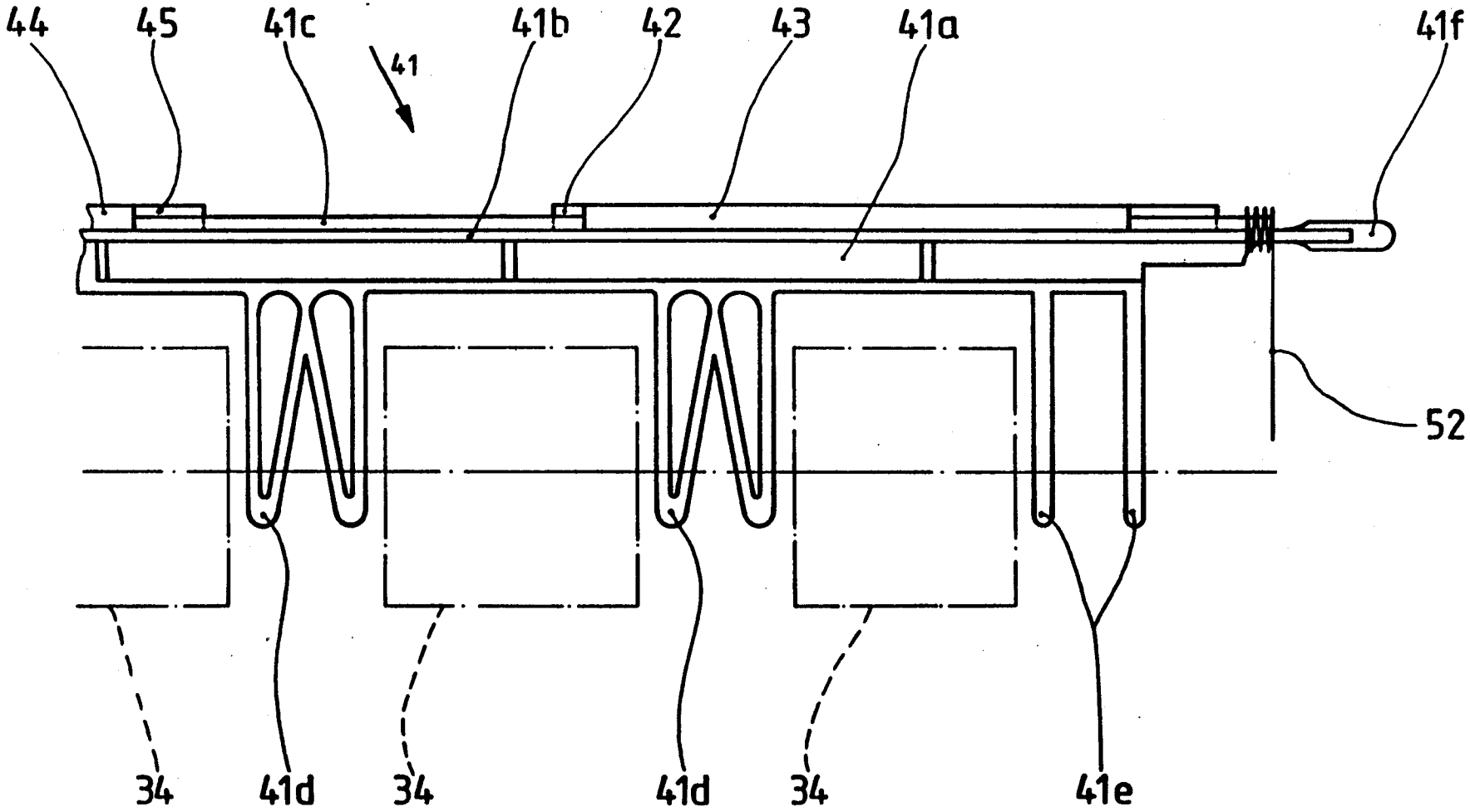
FIG. 3 shows a partial view of the directing element according to FIG. 2.

Directing element 41 consists of a mounting body 41*a* which is arranged transversely to the feedout direction "B" of the sheets, and pivotally mounted on mounting pins 41*f*, arranged at its ends (of which only one is illustrated), and which has integrally designed flexible arms 41*d*, 41*e* extending into the path of movement of the sheets (see FIG. 3). The arms 41*d*, 1*e* pass through coresponding slots 47*b* of the guide surface 47*a* of guide element 47 and are arranged in the spaces between the transport rollers 34 indicated in dash-dotted lines in FIG. 3, as well as adjacent to said transport rollers. Directing element 41 has a web 41*b* provided in the shape of a T in the area of the mounting pins 41*f* and integral with mounting body 41*a*. The web 41*b* has on its upper surface a rib 41*c* located in the plane of the arms 41*d*, 1*e* and extends in the longitudinal direction of mounting body 41*a*.

As shown in particular in FIG. 2, metal bars 42 and 43 respectively are provided on either side of rib 41*c*. These bars rest on web 41*b* and are fixed in a manner (not illustrated in detail), e.g. by locking or bonding. The metal bars 42 and 43 respectively represent a weight which increases the moment of inertia of directing element 41. The weight is unevenly distributed with respect to the axis of pivotal movement (mounting pin 41*f*) of directing element 41 such that the weight of the metal bar 42 facing he folding rollers 19, 21 is greater than that of the opposite metal bar 43. The mounting pins 41*f* are offset from the arms 41*d*, 41*e* by a distance "D" towards the folding rollers 19, 21 whereby the center of gravity of the directing element 41, 42, 43, shown in FIG. 2 in its initial position, is displaced.

In the embodiment the difference in weight is brought about in that metal bar 42 facing the folding rollers 19, 21 is longer and metal bar 43 facing away from said rollers is shorter. To facilitate assembly two spaced metal bar sections 42, 45 and 43, 44 respectively are each provided so that when the first mounting pin 41*f* has been inserted into the mounting provided for it (not illustrated) the second mounting pin can snap into its associated mounting in that the directing element, which consists of a flexible plastic material, is slightly bent. In the case of the embodiment the metal bars 42 and 45 have a weight of 24.5 g while the metal bars 43 and 44 weigh 18 g.

Directing element 41 is preloaded clockwise by a relatively weakly biased resetting spring 52 which is supported by shaft 39.

Directing element 41 functions as follows:

Initially, directing element 41 assumes the position shown in FIGS. 1 and 2 in which its arms 41*d*, 41*e* extend into the path of movement of the folded sheets fed out, and rest against a deflecting surface 46*a* of a deflecting plate 46 locked with the shaft 37 and 38 respectively of folding roller 21 and transport roller 35, respectively.

The folded sheet fed out of the folding rollers 19 and 21 in the direction of the arrow "B" strikes with its front edge against the arms 41*d* and 41*e* and thereby pivots directing element 41 counterclockwise until its arms 41*d* and 41*e* contact shaft 39 of the transport rollers 34. In this upward position the center of gravity of directing element 41 is situated to the left of mounting pin 41*f* as shown in FIG. 2. The greater weight of the metal bars 42 and 45 is located below the axis of rotation of the mounting pins 41*f*. Due to this arrangement directing element 41 does not immediately reverse its direction of movement in spite of the bias of resetting spring 52 but temporarily remains in its position as a result of the action of the moment of inertia. Since the arms 41*d*, 41*e* of directing element 41 are flexible and yield resiliently, their contact with shaft 39 does not cause a rebound effect which would accelerate the reversal of movement.

Only after the moment of inertia has been overcome by the influence of resetting spring 52 and the flexible arms 41*d*, 41*e* is the direction of movement of directing element 41 reversed so that said element can now pivot back rotating clockwise.

This delay in the reversal of the movement of directing element 41 serves to give the folded sheet, fed out in the direction of the arrow "B", sufficient time to unobstructedly slide with its front portion onto the surface elements 31 and 32 before directing element 41 becomes operative again.

When the directing element 41 pivots back clockwise at the predetermined moment, its arms 41*d*, 41*e* depress the rear end of the folded sheet so that when the sheet is given a return impulse by the leaf springs provided on the abutment (not shown), it is guided in a functionally proper manner to slide into the direction of the arrow "C" and onto the transport rollers 35, 40.

The sequence of clockwise pivotal motions of the directing element 41 will be described in more detail as follows: As intended, the directing element 41 initially pivots back in a delayed manner because the metal bars 42 and 45, which are situated below the axis of rotation of the mounting pins 41*f*, must first be lifted. In the course of the further pivotal movement, the weight of the metal bars 42, 43, 44 and 45 is displaced such that the counter force component acting on directing element 41 during its clockwise pivotal movement becomes lower and lower. Since the mounting pins 41*f* are eccentrically offset from the directing element 41 by the distance "D", the metal bars 42 to 45 are brought into a position relative to the axis of rotation of the mounting pins 41*f* in which they subject the directing element 41 to a tilting moment thereby assisting in its clockwise pivotal movement as soon as the arms 41*d*, 41*e* have reached an approximately vertical position.

Thus following the initial delay, movement of the directing element 41 in the clockwise direction is accelerated so that when the rear portion of the folded sheet has left the folding rollers 19 and 21, it is promptly depressed to lie on the surface elements 31 and 32. It is thus ensured that the folded sheet fed out and deposited on the surface elements 31 and 32 can slide (in the manner described) towards the transport rollers 35, 40.

The directing element and its arms 41*d*, 41*e* respectively, shown in their initial positions in FIGS. 1 and 2, serve in connection with another deflecting surface 46*a* of a deflecting plate 46. The plate 46 is locked with the shafts 37 and 38 and serves as a guide, directed at the transport nip of the transport rollers 38, 40, for a sheet arriving from the direction of the arrow "C", and for a folded sheet, respectively.

In contrast to the embodiment illustrated, other weights and/or weight arrangements can also be chosen or rendered operative to influence the moment of inertia of directing element 41 if this appears advisable with respect to the transport speed chosen or a different angular position of the path of movement of the sheet.

It is also possible for the flexible arms 41*d*, 41*e* of directing element 41 to be made from another flexible material and designed as arms which are inserted into mounting body 41*a* (not illustrated).

Another processing procedure for the sheets in finisher 1 can be initiated in that the sheets arriving in the direction of the arrow "A" are deflected into guide channel 18 from which the sheets drop, under the action of gravity, into a device (not illustrated) in which the sheets are collected in sets, and their spines provided with staples, and in which they are then folded in half. The finished folding products are deposited in an output tray (not illustrated). For this purpose the guide channel 18 is controlled in a manner known per se by a pivotable deflector (not illustrated) which is arranged in the area of guide channel 5.

Moreover, cover or slip sheets can also be introduced in each of the guide channels 5 or 18 or 29. Such sheets can, for example, be provided with printed text or can be colored. For this purpose the input tray 2 is preselected on the copier and a sheet removed from it by means of a sheet removal device known per se (and not illustrated) and fed to the corresponding guide channel 5 and 18 and 29 respectively by a pair of transport rollers 3 via a guide channel 4.

The invention has been described in detail with particular reference to preferred embodiments thereof, but it will be understood that variations and modifications can be effected within the spirit and scope of the invention.

What is claimed is:

1. A device for directing individually supplied sheets onto a sheet depositing surface, the directing device comprising:

(a) feeding means for feeding sheets individually along a path of sheet movement onto the depositing surface;

(b) a sheet directing element mounted pivotably about a pivot axis above said path of sheet movement, said directing element having a raised position and a lowered position, and at least one arm extending across said path of sheet movement; and (c) a first weight member for increasing the moment of inertia of said directing element when moving from said raised to said lowered position, said weight member being mounted to a portion of said directing element above said pivot axis thereof.

2. The directing device of claim 1 wherein said directing element has first and second arms, said first arm being located below said pivot axis and extending across said path of sheet movement when in a lowered position, and said second arm being located above said pivot axis.

3. The directing device of claim 1 including a resetting spring for biasing said first arm of said directing element into a lowered position across said path of sheet movement.

4. The directing device of claim 1 including a second weight member mounted above said pivot axis and facing oppositely from said first weight member relative to the direction of sheet movement along said path of sheet movement.

5. The directing device of claim 2 including a plurality of said directing elements.

6. The directing device of claim 4 wherein said first weight member is heavier than said second weight member.

7. The directing device of claim 6 wherein said first arm of said directing element is resilient and together with said first and second weight members functions to create a momentary delay in the resetting, to a lowered position, of a raised directing element.

* * * * *